US008042827B2

(12) United States Patent
Karlsen

(10) Patent No.: US 8,042,827 B2
(45) Date of Patent: Oct. 25, 2011

(54) SNOWBOARD AND SKI

(75) Inventor: Jorgen Karlsen, Hovik (NO)

(73) Assignee: HiTurn AS, Raufoss (NO)

( * ) Notice: Subject to any disclaimer, the term of this patent is extended or adjusted under 35 U.S.C. 154(b) by 40 days.

(21) Appl. No.: 11/667,047

(22) PCT Filed: Nov. 4, 2005

(86) PCT No.: PCT/NO2005/000420

§ 371 (c)(1),
(2), (4) Date: Feb. 27, 2008

(87) PCT Pub. No.: WO2006/049508

PCT Pub. Date: May 11, 2006

(65) Prior Publication Data

US 2009/0008906 A1 Jan. 8, 2009

(30) Foreign Application Priority Data

Nov. 5, 2004 (NO) ..... 20044842

(51) Int. Cl.
*A63C 5/06* (2006.01)

(52) U.S. Cl. ..... 280/602; 280/609

(58) Field of Classification Search ..... 280/609, 280/601, 11.12, 611, 841, 7.13
See application file for complete search history.

(56) References Cited

U.S. PATENT DOCUMENTS

| | | | |
|---|---|---|---|
| 3,326,564 | A | 6/1967 | Heuvel |
| 5,129,668 | A | 7/1992 | Hecht |
| 5,301,965 | A | 4/1994 | Floreani |
| 5,511,815 | A | 4/1996 | Karlsen |
| 5,876,056 | A | 3/1999 | Karlsen |
| 6,488,308 | B1 | 12/2002 | Clausing |

FOREIGN PATENT DOCUMENTS

| | | | |
|---|---|---|---|
| DE | 3223413 | 1/1983 | |
| FR | 2794374 | * 12/2000 | |
| WO | WO 95/21662 | 8/1995 | |
| WO | WO 03/039686 | 5/2003 | |
| WO | WO03/039686 | * 5/2004 | ..... 280/602 |

* cited by examiner

*Primary Examiner* — Frank Vanaman
(74) *Attorney, Agent, or Firm* — Merchant & Gould P.C.

(57) ABSTRACT

A snowboard or ski (1) is made having a flat sole, seen in cross-section, and with a longitudinal bendable zone or zones so that the whole or parts of the right-hand and/or left-hand part of the board are bendable in such manner that the sole, seen in cross-section, is or can be curved upwards in these parts of the board, thus causing the steel edges outermost on the upward curved portions to be higher than the sole in the middle of the board. The board may be equipped with tensioning means to hold these portions permanently flexed upwards.

Figures 1A, 1B, 1C, 1D, 1E, 1F:
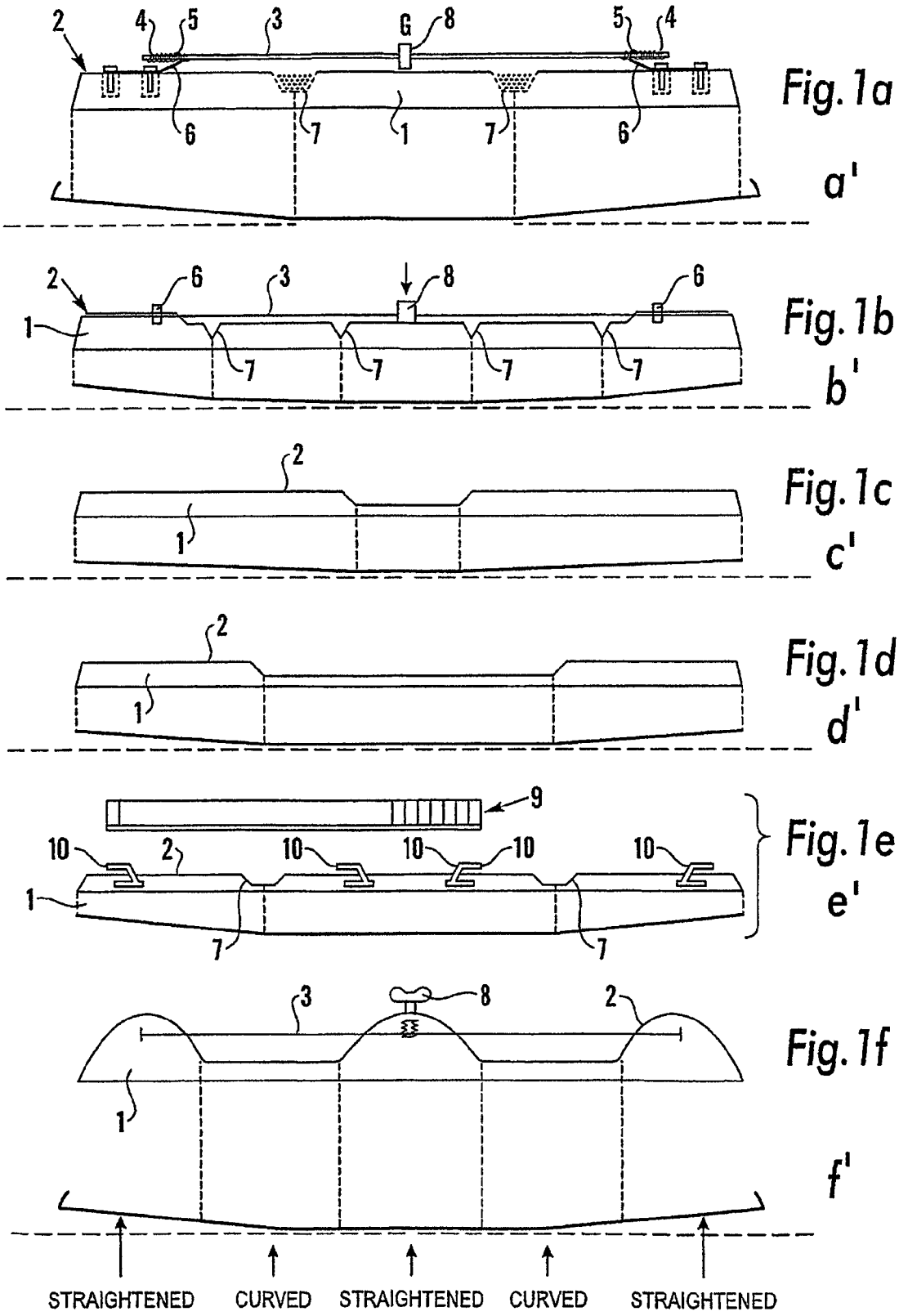

5 Claims, 3 Drawing Sheets a' b' c' d' e' f'
STRAIGHTENED
CURVED
STRAIGHTENED
CURVED
STRAIGHTENED

SNOWBOARD AND SKI

The invention relates to a snowboard or ski, which is manufactured with a flat sole.

The object of the invention is to provide a board where the sole in cross-section can curve upwards when in use. This is achieved by means of the features of the invention that are set forth in the patent claims.

In the invention:

1. either there are inserted longitudinal zones which cannot be compressed in the underside of the board (at the sole), but which in the upper side of the board either consist of a recess or a material that can be compressed or flexed, after which there are integrated or top-mounted transverse tensioners which can be used to keep the upper surface of the board or ski drawn together in such manner that the desired lifting of the soles along the steel edges is obtained; or
2. there are inserted longitudinal zones which cannot be compressed in the upper side of the board, but which in the underside of the board either consist of a material that can expand, or a mechanical device that can force the sections apart. Alternatively, the sole is split to allow a wedge-shaped profile to be inserted from the underside after manufacture, so as to obtain the lifted effect of the steel edges and adjacent sole.

There are already known both skis and snowboards which are premoulded in the shape which this board assumes when the crossbars are tightened or the underside is made wider. The advantages of the invention are several:

1. It is easier to make a flat board or ski, where sanding and preparation are concerned.
2. It is easier to maintain a flat board or ski, where sanding and preparation are concerned.
3. The user himself can decide what angle the lateral surfaces should have and adjust them to his use.

Thus, the invention provides clear advantages over boards or skis that are premoulded in the shapes that they first have after manufacture. It should be possible to sell the boards according to the invention in a flat state, so that the shops or the user of the board can adjust the shape of the board or ski to that required.

An alpine pair ski is known from Norwegian Patent 172 170, which on a forward portion of no more than 20 cm in length has a sliding surface that diverges upwards when the steel edge diverges outwards from the longitudinal axis of the ski. The object of this ski is to turn with a minimum loss of kinetic energy. An alpine pair ski is known from PCT/NO95/00030, which on a portion that is longer than 20 cm has a sliding surface that diverges upwards when the steel edge diverges outwards from the longitudinal axis of the ski. The object of this ski is to turn with a minimum loss of kinetic energy, but with a more harmonious design than that described in Norwegian Patent 172 170.

From Norwegian Patent No. 301 964, which corresponds to EP 748245, there is known an alpine pair ski with a flat first sliding surface and lateral surfaces provided with an almost continuously concave side-cut between a first transition line defining the transition between a tip portion and a forward portion and a second transition line defining the transition between the main portion and a rear portion. The course of the lower lateral edge between the transition lines approximates a continuous curve. The sole on both sides of the first sliding surface comprises additional sliding surfaces which extend upwards from the edge of the first sliding surface to the lower lateral edges on the ski with an upward curve or uplift. The additional sliding surfaces extend in the longitudinal direction of the ski, at least from the first and the second transition lines, respectively, towards a transversal line behind the middle of the ski and in the portion of the ski where the binding is attached, the width of the ski at the transversal line being equal to the smallest width of the ski between the transition lines. The uplift in the lower lateral edge on the additional sliding surfaces increases substantially with the increasing width of the ski in the direction of the two transition lines.

Figure 5A:
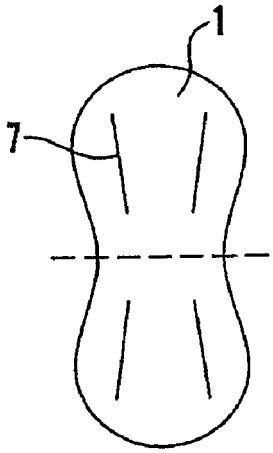
Figure 5B:
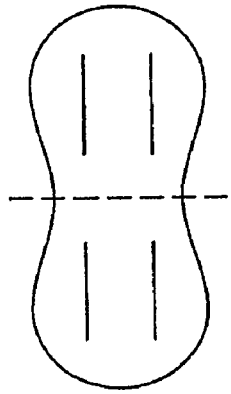
Figure 5C:
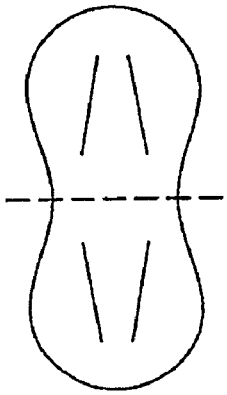
Figure 5D:
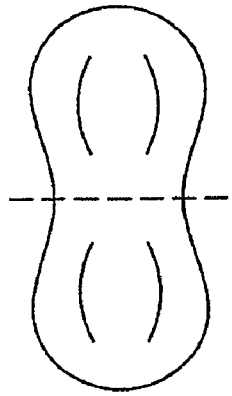
Figure 5E:
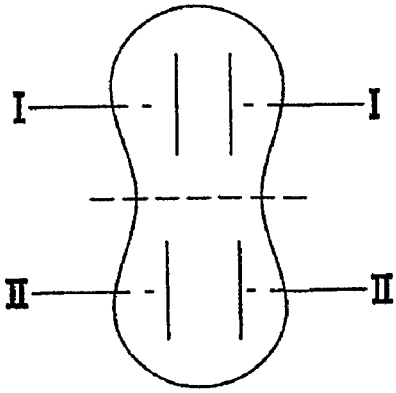
Figure 5E:
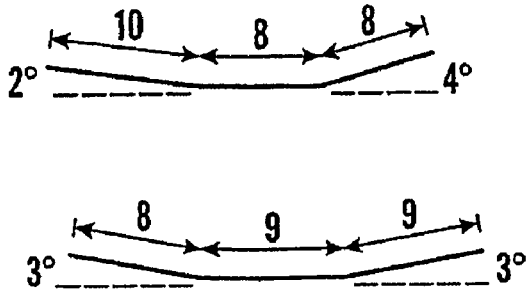

The most common form of boards with upwardly curved lateral sliding surfaces is that they are almost symmetrical about both the longitudinal axis and the central transversal axis. The bending zones may be parallel to the longitudinal axis, or run in other directions which deviate from the longitudinal axis. Examples are illustrated schematically in FIGS. 5*a*-5*d*. In addition, the different parts of the board may also in principle form mutual asymmetries, for example, as illustrated in FIG. 5*e*, wherein:

a) the central flat sole portion is wider at the forward section of the board than at the rear section of the board, or vice versa;
b) the central flat sole portion starts further forward of the centre of the board than behind the centre, or vice versa;
c) the secondary sole portion is wider on the left-hand side than on the right-hand side of the board, or vice versa;
d) the secondary sole portion and the bending portion are made so that when tension is applied, a greater angle is formed with the central flat sole portion on the left-hand side than on the right-hand side, or vice versa;
e) the secondary sole portion and the bending portion are made so that when tension is applied, a greater angle is formed with the central flat sole portion forward of the centre than behind the centre, or vice versa.

The invention will now be explained in more detail with the aid of figures which show possible embodiment variants of the invention.

Figure 2A:
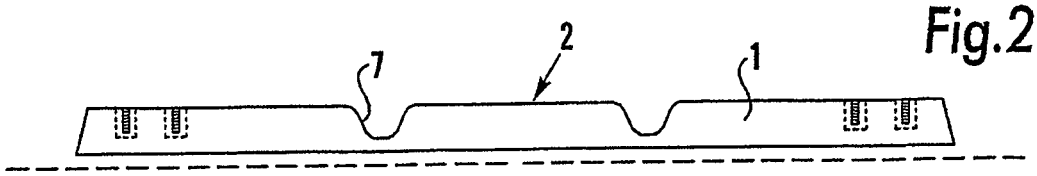
Figure 2B:
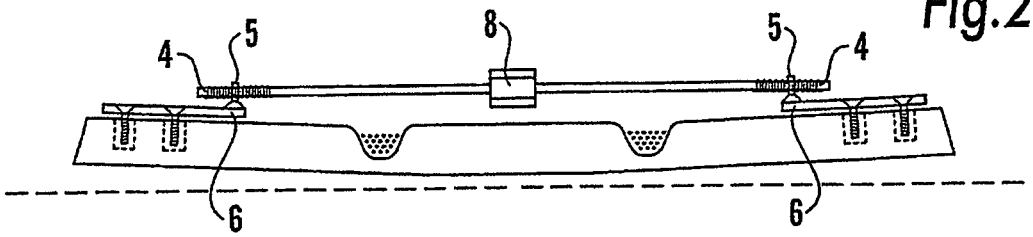

FIGS. 1*a*-1*f* show six examples of the embodiment of the snowboard according to the invention;

FIGS. 2*a*-2*b* illustrate an additional example showing two forms in connection with the manufacture of the board according to the invention;

FIGS. 3*a*-3*b* and 4*a*-4*b* show embodiments of the invention in connection with skis; and FIGS. 5*a*-5*e* are a schematic view illustrating bending lines on a snowboard.

FIGS. 1*a*-1*f* show six cross-sections of different snowboards 1 according to the invention with the drawing together of the upper side 2 shown in a cross-section before the transverse tensioners are tightened, that is to say, as the boards come off the production line. A line under each figure simply shows the sole profile after tensioning. These lines are designated a', b', c', d', e' and f. FIGS. 1*a*, 1*b* and 1*f* are shown with possible tensioners.

The tensioner in FIG. 1*a* has a transverse rod 3 with oppositely directed threads 4 at its ends. On these are mounted threaded elements 5 which, when the rod 3 is turned using a nut 8, tighten or slacken via a connection 6 a fastening on the board or ski so that it is curved or straightened. In the board 1 there are notches 7 to enable the board to be flexed into the shape in FIG. a'. These notches may be filled with a soft or pliable material.

The tensioner in FIG. 1*b* works with a plurality of notches 7. The tensioner has a bar or rod 3 with a centrally positioned piston part 8 which, in steps or on turning, can be depressed and produce a curved shape b'.

FIGS. 1*c* and 1*d* show two alternative embodiments of the board surface, which give different bending patterns. Making the central portion thinner will allow a curve to be formed in that portion, whilst the side portions are flexed upwards but remain flat. Tensioners are not shown as many variants may be suitable, for example, the others that are shown.

FIG. 1*e* is an embodiment with a tensioner rod 9 that is hooked onto hooks 10 manually. When the board is flexed, the rod 9 can be unhooked from the hooks 10.

The hook pairs are offset from one another.

The tensioner in FIG. 1*f* works according to the same principle as that in FIG. 1*b*, but in this case is made with a tightening screw. The shape of the board or ski is different and causes a different curvature f with alternating straight and curved portions.

FIGS. 2*a*, 2*b* illustrate the production stages for the manufacture of boards/skis according to the invention.

FIG. 2*a* shows roughly the same board or ski as shown in FIG. 1*a* as it will look immediately after production of the board part, showing only the threaded inserts. FIG. 2*b* shows the same cross-section with brackets in place on the right and left-hand sides, and a threaded rod with right-hand and left-hand threads and a nut in the centre for tightening with a spanner or wrench. It will be seen that the sole on each side forms an angle with the sole in the centre because the rod has been tightened and the right-hand and left-hand upper sides of the board have been drawn closer together. FIG. 2*a* thus shows a flat board with longitudinal fastening devices on each side. The threaded inserts must be one of two things: either it must be possible to screw a holder for the crossbars down into the threaded insert, or the threads must be fastened to the board and have the hole transverse to the board so that the threaded rods can be screwed into them. In FIG. 2*b* the board is made having a device that fits with a threaded bracket. It is often difficult to put a bidirectional threaded rod in place, unless there is a loose bracket into which the threads run, whereupon this bracket is simply snapped into place on each side and tightened.

Figure 3A:
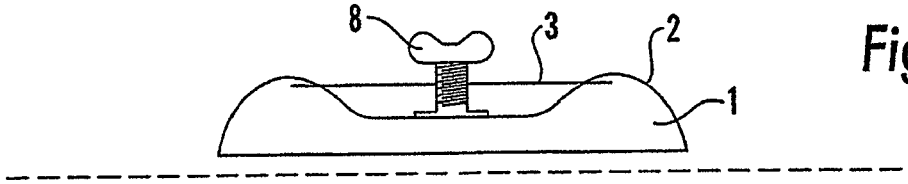
Figure 3B:
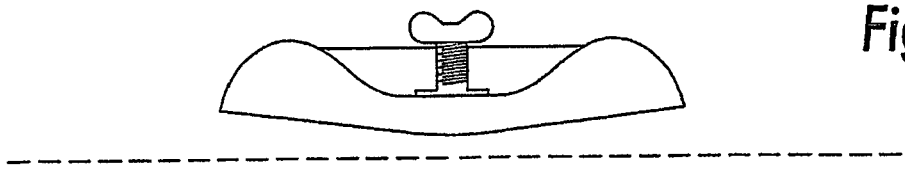

FIG. 3*a* shows a dimension that is more typical for skis, although the principle is the same for snowboards. The ski or board is manufactured flat, and has the tensioning mechanism mounted but not tightened. FIG. 3*b* shows the tightened form; because the central portion of the ski is thin and not as rigid, the central portion is curved whilst the side portions retain their shape, both on the underside and on the upper side. In this case, the whole of the otherwise thin, flat central portion can be flexed when the ski is drawn together. I.e., about ⅓ of the central longitudinal part of the ski is allowed to be thin and thus bendable.

Figure 4A:
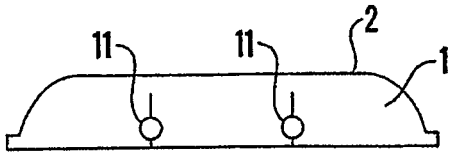
Figure 4B:
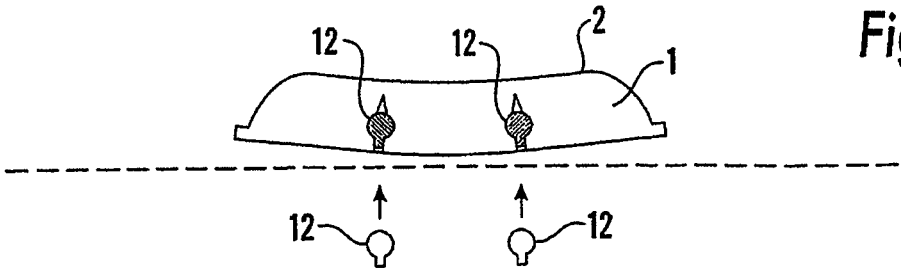

FIG. 4*a* shows a solution with two slots 11 in the sole surface of the ski (the snowboard). Both one and more slots 11 may be used, optionally with a hollow space that is configured so as to prevent the profile 12 that is inserted from falling out again. FIG. 4*b* shows the same cross-section after the profile 12 has been inserted. In this case, a rod is not used, but a wedge or profile 12 is inserted from below (the sole side) in order to obtain a "Triple Base".

It should be pointed out that the invention can be used on both snowboards and skis. Although the embodiments in FIG. 1 and FIG. 2 are shown with a width corresponding to a board, these embodiments can also be used with skis.

To give an idea of the position of the transitions from the central portion to the lateral portion, reference is made is FIGS. 5*a*-5*e*. As mentioned above, different board types are illustrated schematically. The lines on the board indicate the transitional areas from the central portion to the lateral portion and the division into different areas on a board. FIG. 5*e*, which shows an asymmetrical board, includes two sectional views illustrating the position of the bending zones and possible variations in size and angles.

As can be seen, a desired shape can be obtained on the basis of a number of different shapes of boards and skis, and here only a small number of these shapes have been shown. As regards methods for tensioning the surface, there are very many known techniques that can be used. The invention is also intended to comprise such modifications.

The invention claimed is:

1. A snowboard or ski comprising:

(a) a board or ski having:

(i) a sole wherein the sole is flat when seen in cross-section and when not under tension, the sole having a middle part, a left-hand side part and a right-hand side part, and having outermost steel edges;

(ii) a longitudinal direction extending along a length of the board or ski; and (iii) at least one bendable zone extending in the longitudinal direction in the board or ski; wherein the at least one bendable zone comprises a thinner area of the board or ski; and (b) tensioners constructed to hold the left hand side part and the right hand side part of the sole permanently flexed upwardly so that the steel edges are higher than the middle part of the sole, when seen in cross-section, and the resulting curving of the sole being substantially greater inside the tensioners than close to the steel edges;

(c) wherein the tensioners are transverse tensioners and wherein on upper sides of a right-hand part and a left-hand part of the board or ski there are attachments constructed to secure the transverse tensioners so that said upper sides of the board or ski can be drawn towards each other using the tensioners, thereby ensuring that the board or ski retains an upwardly flexed shape.

2. A snowboard or ski according to claim 1, wherein the transverse tensioners are located immediately beneath, in or on the top of said upper sides of the board or ski.

3. A snowboard or ski according to claim 1, wherein on said upper sides close to the steel edges there is a longitudinal projection which functions both as the attachment for the tensioners, and as a stiffener for the board or ski in the longitudinal direction so that fewer tensioners are required to give the board or ski uniformly upwardly flexed lateral surfaces.

4. A snowboard or ski according to claim 1, wherein the board or ski includes notches enabling the board or ski to be flexed into a desired shape, where the notches are filled with a soft or pliable material that can be compressed or flexed.

5. A method for the manufacture of a board or ski, wherein the board or ski is manufactured having:

(a) a sole wherein the sole is flat when seen in cross-section and when not under tension, the sole having a middle part, a left-hand side part and a right-hand side part, and having outermost steel edges;

(b) a longitudinal direction extending along a length of the board or ski; and (c) at least one bendable zone extending in the longitudinal direction in the board or ski; wherein the at least one bendable zone comprises a thinner area of the board or ski;

wherein transverse tensioners are mounted to attachments located on upper sides of a right-hand side part and a left-hand side part of the board or ski transverse to the ski or board, which, when tightened draw the left hand side part towards the right hand side part, thereby ensuring that the board or ski retains a permanently upwardly flexed shape so that the steel edges are higher than the middle part of the sole, when seen in cross-section, and the resulting curving of the sole being substantially greater inside the tensioners than close to the steel edges.

* * * * *